United States Patent [19]

Taylor

[11] 3,981,255

[45] Sept. 21, 1976

[54] CURTAIN HEMMING DEVICE

[75] Inventor: Hervey Taylor, Candor, N.C.

[73] Assignee: Home Curtain Corporation, Far Rockaway, N.Y.

[22] Filed: May 27, 1975

[21] Appl. No.: 580,763

[52] U.S. Cl. ..... 112/155; 112/203

[51] Int. Cl.[2] ..... D05B 25/00

[58] Field of Search ..... 112/155, 178, 121.14, 112/203, 121.11, 147, 141, 121.12

[56] References Cited

UNITED STATES PATENTS

| | | | |
|---|---|---|---|
| 1,578,324 | 3/1926 | Klau | 112/155 |
| 2,249,423 | 7/1941 | Gialkin | 112/155 |
| 2,619,057 | 11/1952 | Ellis, Sr. | 112/203 |
| 3,012,603 | 12/1961 | Newsome et al. | 112/147 UX |
| 3,187,700 | 6/1965 | Davy | 112/203 |
| 3,371,630 | 3/1968 | Cash, Jr. | 112/121.14 |
| 3,610,493 | 10/1971 | Brocklehurst | 112/203 X |
| 3,722,435 | 3/1973 | Elsas | 112/121.11 |
| 3,745,947 | 7/1973 | Brocklehurst | 112/121.11 |

*Primary Examiner*—Werner H. Schroeder
*Assistant Examiner*—Moshe I. Cohen
*Attorney, Agent, or Firm*—Charles E. Temko

[57] ABSTRACT

A device for simultaneously hemming each side of a continuous planar web of textile or similar material utilizing a pair of known blind-stitch sewing machines, each operating in conventional manner and direction of rotation in synchronism with the other. One of the sewing machines is driven in standard fashion, and the other of said sewing machines is coupled thereto in such manner that varying widths of web may be accommodated in planar condition without the necessity of forming a centrally disposed longitudinally arranged fold in the web. The machine driven in standard fashion is adjustably positionable upon a frame element at varying distances from the other of said sewing machines to accommodate the varying widths. The other machine is in relatively fixed condition upon the frame element, and the parts disposed above and below the web are driven through linkages disposed laterally outward of the frame element, so as to provide a clear path for the web passing therebeneath.

3 Claims, 4 Drawing Figures

CURTAIN HEMMING DEVICE

BACKGROUND OF THE INVENTION

This invention relates generally to the field of sewing devices, and more particularly to an improved device for the hemming of two parallel sides of a web of textile or other material, whereby the finished web may be subsequently transversely severed into desired lengths, as when making curtain panels and the like. Devices of this general type are known in the art, and the invention lies in specific constructional details permitting improved ease of operation, servicing and adjustment.

Among the problems encountered with prior art devices of the above type are the inability to adjust for varying widths of web without the necessity of at least temporarily forming a longitudinal centrally disposed fold in the web, and the provision of structure to support the folded material during the sewing operation. Another difficulty has been the inability to employ sewing machine components of so-called "blind-stitch" type which are not capable of operation in two directions of web feed, and which therefore cannot be arranged in symmetrical disposition upon a frame beneath which the cloth web passes.

SUMMARY OF THE INVENTION

Briefly stated, the invention contemplates the provision of a device of the class described in which the above mentioned disadvantages have been substantially eliminated. Chain stitch type blind sewing is accomplished by an opposed pair of sewing machines of known type, one of which is operated in normal manner, and the other of which is driven through other than normal driving linkage and is supported from transversely extending members of a frame element to define an interstice between those elements disposed above the web of cloth being sewn and those elements disposed below the web, whereby the web is free to pass without interference through an area which would otherwise be occupied by conventional driving linkage. Means is incorporated for interruption of operation of the device should the thread passing through either sewing machine break, thereby preventing the continued formation of a web which is only partially hemmed.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
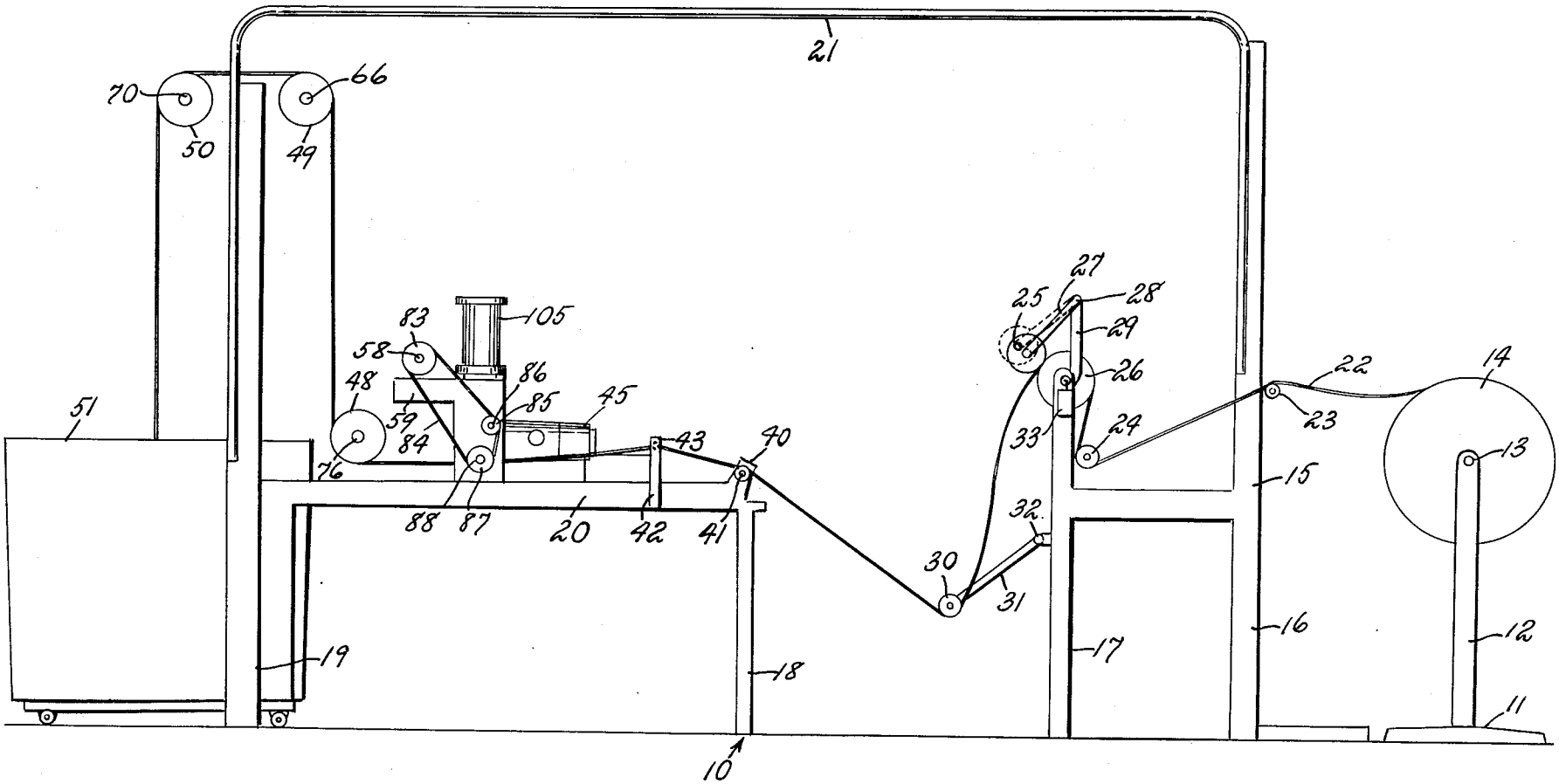
FIG. 1 is a side elevational view, somewhat schematic, of an embodiment of the invention.
Figure 3:
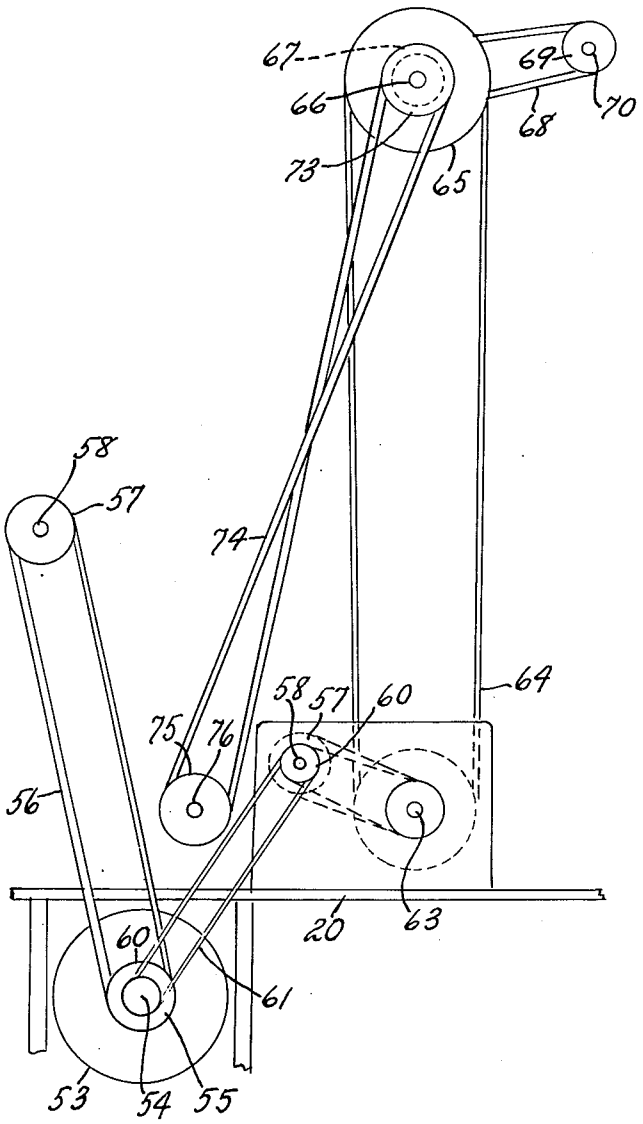
FIG. 3 is an end elevational view thereof showing the end opposite that seen in FIG. 2.

In accordance with the invention, the device, generally indicated by reference character 10 (FIG. 1) includes a material supply element 11 having a pair of stanchions, one of which is indicated by reference character 12. A transversely extending axle 13 supports a roll of material 14 to be hemmed adjacent one end of a frame element 15 including a plurality of legs 16, 17, 18 and 19 which support a table 20. Hollow conduit means 21 may be employed to carry electrical conductors (not shown) to the prime mover and operative motors, in a manner well known in the art. A web 22 of material is fed over a fixed bar 23, around an idler roller 24 and through the interstice between a nip roller 25 and a driven feed roller 26. The nip roller 25 is mounted for orbital movement on levers 27 which pivot at points 28 from upstanding supports 29 on the frame element 15.

The driven roller 26 is controlled by a dancer roller 30 mounted on linkage 31 pivoted at points 32. Movement of the dancer roller 30 operates a switch (not shown) to power a motor 33 which drives the roller 26 in well known fashion, whereby a loop of material is maintained between fixed limits. The loop feeds a spaced pair of hemming devices 34, each including a fixed member 35 mounted on the frame element and pivotal members 36 and 37 which form a gap 38 through which an edge 39 of the web 22 passes. A second pair of hemmers 40 are mounted on a transversely extending rod 41. Upstanding rods 42 support a third pair of hemmers 43 immediately opposite left and right hand sewing machines 45 and 46, respectively. The web 22 is advanced continuously by driven rollers 48, 49 and 50, the finished product being moved to a collection basket 51 for removal at periodic intervals.

A prime mover 53 is supported under the table 20 at one transverse end thereof and includes an output shaft 54 having a first larger pulley 55 connected by a V-belt 56 to a pulley 57 on a shaft 58 journaled on a transverse member 59 of the frame element 15. A smaller concentrically arranged pulley 60 is connected by a belt 61 to a variable V-belt drive reduction unit of well known type, the output shaft 63 of which is connected by a belt 64 to a pulley 65 on a shaft 66. The shaft 66 mounts a pulley 67 connected by a belt 68 to a pulley 69 on a shaft 70 whereby the rollers 49 and 50 are rotated in the same direction. Another pulley 73 drives a belt 74 entrained on a pulley 75 on a shaft 76 to rotate the feed roller 48 in an opposite direction.

Figure 4:
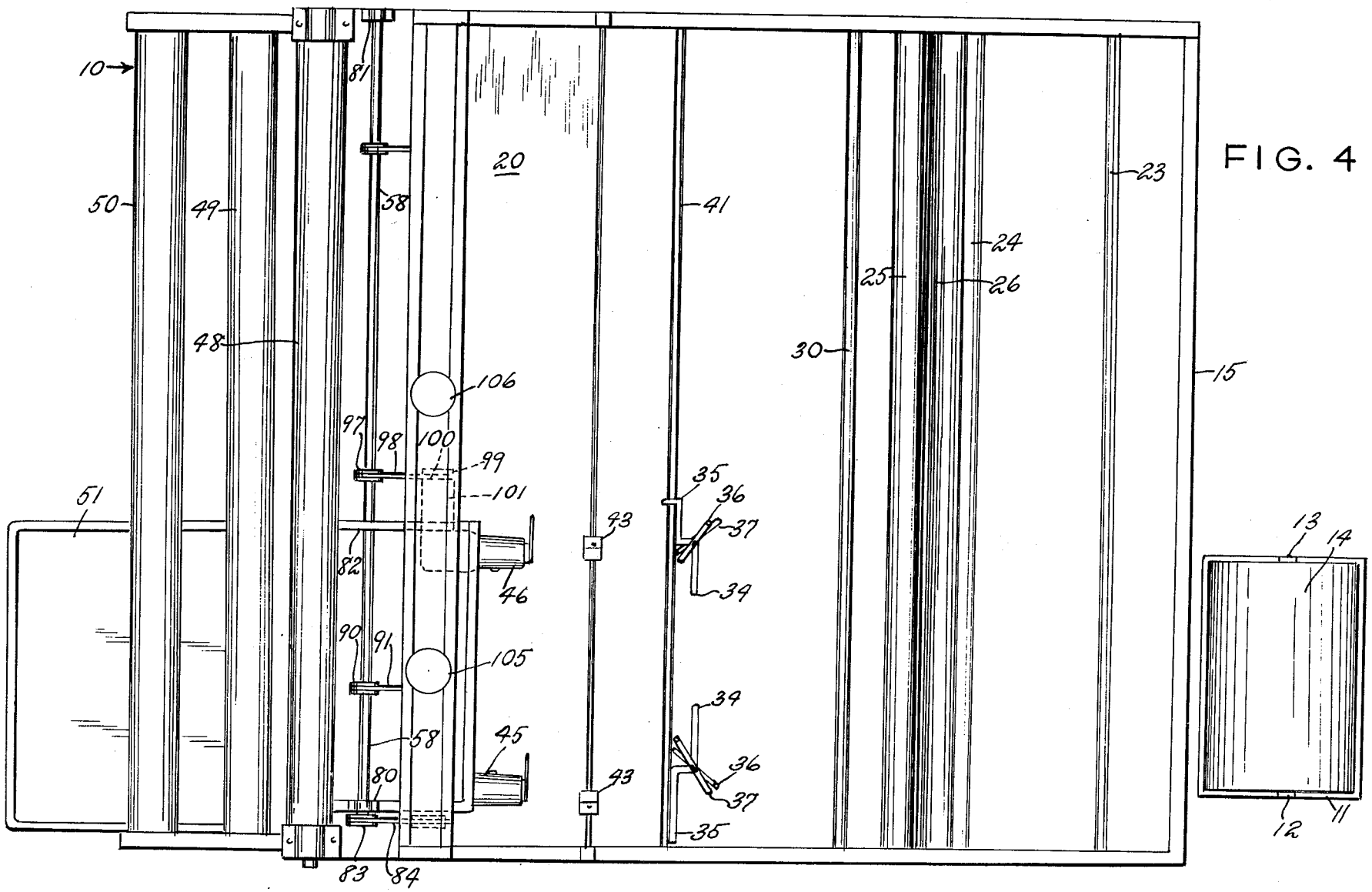
FIG. 4 is a top plan view thereof.

See FIGS. 1 and 4, the shaft 58 includes end journals 80 and 81 as well as a medially disposed journal 82. Extending outwardly of the journal 80 is a cogged pulley 83 driving cog belt 84 which passes over a tensioning pulley 85 on a shaft 86 and a driven pulley 87 on a shaft 88, thereby transferring synchronized motion from the upper part of the left hand sewing machine 45 to the lower part thereof. Operation of the machines 45 and 46 is similar to that disclosed in the McFaddin U.S. Pat. No. 2,949,086 of Aug. 16, 1960, in which a curved needle effects a blind stitch in that portion of the cloth which is elevated by a continuously rotating cam disposed beneath the sewing plane. As this type of operation is very well known in the art, it need not be considered further in this disclosure.

Figure 2:
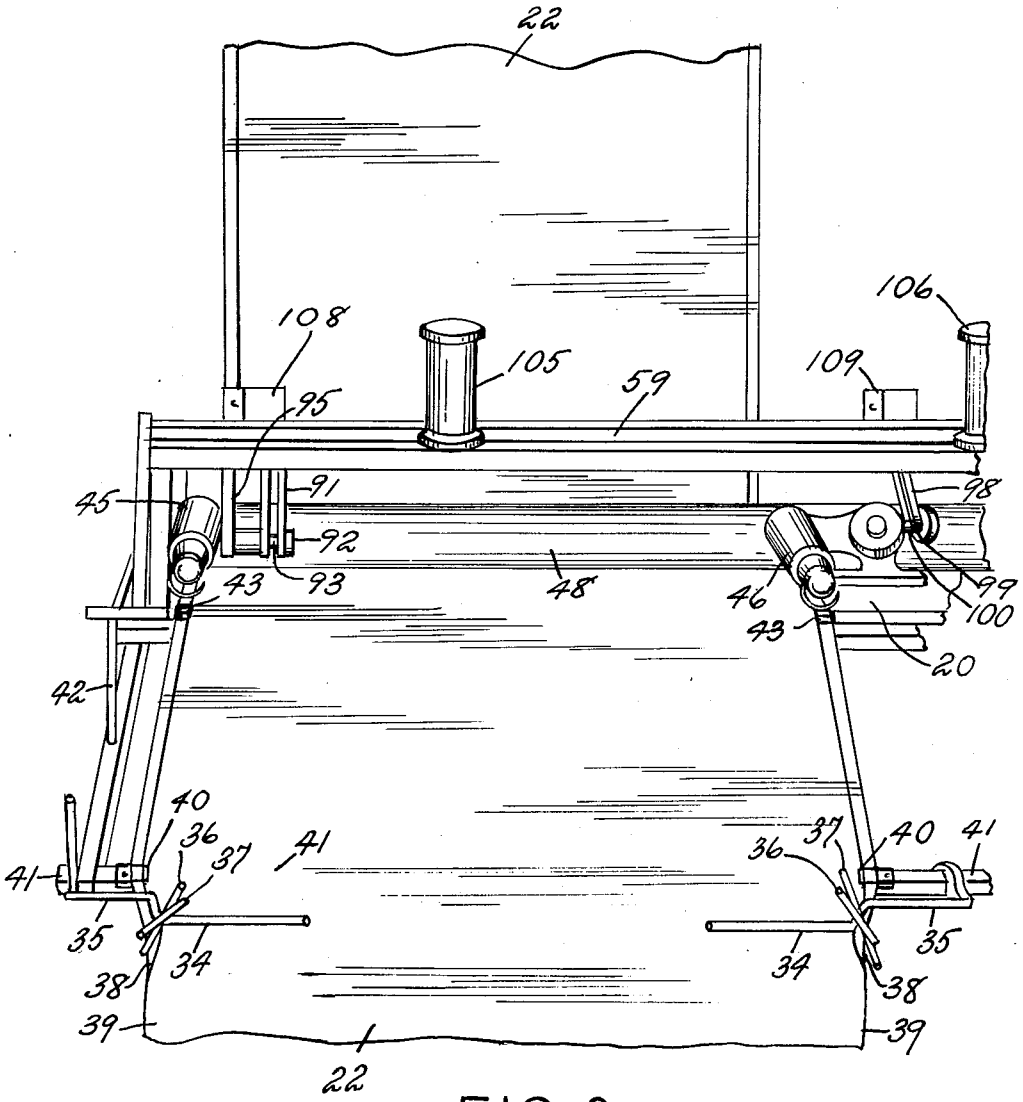
FIG. 2 is a fragmentary end perspective view thereof, with certain feeding structure eliminated for purposes of clarity.

A medial cogged pulley 90 on the shaft 58 drives cog belt 91 (FIG. 2) engaging cogged pulley 92 on a shaft 93 whereby motion is transmitted to the needle of the sewing machine 45. As this machine will normally remain in one position irrespective of the width of cloth web being accommodated, it is best removed from its original housing (not shown) and supported by a bracket 95 from an undersurface of the transversely extending member 59.

The right hand sewing machine 46 is driven through its original internal linkages, since these linkages will normally be disposed outwardly of the web during the sewing operation. Synchronized motion is transmitted through a driving cog pulley 97 on the shaft 58, the pulley being slideably adjustable thereon by splined or other equivalent means. Pulley 97 drives a cogged belt 98 entrained over a pulley 99 on the driven main shaft 100 of the sewing machine 46. The housing 101 thereof is either slideably or otherwise adjustably mounted on the table 20 whereby it may be laterally adjusted to proper position depending upon the width of the web being sewn.

Each of the machines 45 and 46 is provided with individual thread feeding supplies at 105 and 106, respectively. Thread passes through tensioning devices 108 and 109, which include electrical switch means (not shown) whereby should either thread break, and tension be released, the switches may interrupt operation of the motor 53. As this structure is also known in the art, it need not be described in greater detail.

During operation, each of the two sewing machines operates in normal direction of feed, with the driver rollers 48-50 providing movement of the web as the sewing operation proceeds. The left hand machine, the components of which are driven through linkage means disposed externally of the frame element, provides a complete interstice through which the left hand edge of the web may pass without interference. The right hand machine is disposed laterally outwardly of the web, except for the sewing area, and as its synchronizing linkage remains intact, it may be bodily shifted laterally along the frame element to accommodate for any desired width of web.

It is to be understood that it is not considered that the invention lies within the specific details of structure shown and set forth in this specification, for obvious modifications will occur to those skilled in the art to which the invention pertains.

What is claimed is:

1. In a device for forming a hemmed edge on each side of a continuous web of material, said device including a main frame element having a principal longitudinal axis and a transversely extending supporting member, and first and second sewing machines positioned in the area of each hemmed edge, means for driving said first and second sewing machines in synchronism, and means for advancing said web in synchronism with said machines, the improvement comprising: one of said sewing machines being in fixed location relative to said frame element, the other of said sewing machines being selectively positionable at a plurality of locations along a transverse axis relative to said frame element; prime mover means mounted upon said frame element, a transversely extending shaft mounted for rotation upon said frame element and driven by said prime mover means; said one of said sewing machines being supported from said transversely extending supporting member, and having belt means driven from said transversely extending shaft to oscillate stitch forming means thereon; said frame element including a second transversely extending support means, said means carrying fabric elevating means cooperating with said stitch forming means, and forming an interstice therebetween through which a web of fabric may pass; said transversely extending shaft projecting outwardly of said frame element and mounting a driven pulley, said second transversely extending support means carrying a pulley driving said fabric elevating means, there being belt means interconnecting said last two mentioned pulleys.

2. Structure in accordance with claim 1, further characterized in the other of said sewing machines including a housing incorporating stitch forming means and fabric elevating means, said housing being shiftable as a unit along said second transversely extending support means, said transversely extending shaft having a driven pulley selectively positionable therealong and having belt means driving the other of said sewing machines.

3. Structure in accordance with claim 2, further characterized in the provision of a plurality of feed rollers extending transversely relative to said frame element, and means interconnected with said prime mover means for advancing a web of fabric in synchronization with operation of said sewing machines.

* * * * *